US010668348B1

(12) United States Patent
Jones

(10) Patent No.: US 10,668,348 B1
(45) Date of Patent: Jun. 2, 2020

(54) TIMING BALL

(71) Applicant: Jason G. Jones, Fort Mitchell, AL (US)

(72) Inventor: Jason G. Jones, Fort Mitchell, AL (US)

( * ) Notice: Subject to any disclaimer, the term of this patent is extended or adjusted under 35 U.S.C. 154(b) by 0 days.

(21) Appl. No.: 16/435,471

(22) Filed: Jun. 8, 2019

Related U.S. Application Data

(63) Continuation of application No. 15/439,088, filed on Feb. 22, 2017, now Pat. No. 10,357,701, which is a continuation of application No. 62/303,842, filed on Mar. 4, 2016.

(51) Int. Cl.
*A63B 69/22* (2006.01)
*A63B 69/20* (2006.01)
*A63B 71/02* (2006.01)

(52) U.S. Cl.
CPC ..... *A63B 69/205* (2013.01); *A63B 2071/025* (2013.01); *A63B 2210/50* (2013.01); *A63B 2225/093* (2013.01)

(58) Field of Classification Search
CPC ..... A63B 69/205; A63B 69/32
USPC ..... 482/90
See application file for complete search history.

(56) References Cited

U.S. PATENT DOCUMENTS 445,747 A * 2/1891 Cook ..... A63B 69/201 482/86
582,583 A * 5/1897 Fitzimmons ..... A63B 69/208 482/90
668,279 A * 2/1901 Bean ..... A63B 69/208 482/90
732,740 A * 7/1903 Hansen ..... A63B 69/208 482/90
868,557 A * 10/1907 Hart ..... A63B 69/205 482/87
992,868 A * 5/1911 Gorman ..... A63B 69/205 482/87
1,578,633 A * 3/1926 Bonde ..... A63B 69/205 482/90
3,030,109 A * 4/1962 Albitz ..... A63B 69/205 482/88
4,216,957 A * 8/1980 Curatola ..... A63B 69/20 248/161

(Continued)

FOREIGN PATENT DOCUMENTS

GB 190412996 A * 7/1904

*Primary Examiner* — Joshua T Kennedy

(57) ABSTRACT

A striking apparatus for all fighting art forms such as boxing to improve a user's fighting skills. The striking apparatus includes a timing ball having a link disposed thereon; an elongated adjustable rope; a swivel mounted to a swivel plate, the swivel plate being mounted to a backboard; the backboard being optionally attached to a frame; the link disposed on the timing ball being attached to the elongated adjustable rope, the rope being attached to the swivel; and the timing ball configured to be struck by the knuckles of a user's fist. Another embodiment of the invention includes a punching apparatus station for all fighting art forms which generally includes the same configuration as the striking apparatus referenced-above. Importantly, the striking apparatus advantageously is a cross between a speed bag, a double end bag, and a maze ball but is beneficially more effective than all three.

11 Claims, 10 Drawing Sheets

(56) References Cited

U.S. PATENT DOCUMENTS

| | | | | |
|---|---|---|---|---|
| 4,403,772 | A * | 9/1983 | Stangle | A63B 17/00 482/83 |
| 5,944,639 | A * | 8/1999 | Ray | A63B 69/205 482/83 |
| 6,220,992 | B1 * | 4/2001 | Shafik | A63B 69/20 482/104 |
| 9,975,028 | B2 * | 5/2018 | Adams, Jr. | A63B 69/205 |
| 2010/0190612 | A1 * | 7/2010 | Cook | A63B 71/023 482/38 |

* cited by examiner

TIMING BALL

PRIORITY CLAIM

This application is a continuation of U.S. non-provisional patent application Ser. No. 15/439,088, entitled "Timing Ball", filed on Feb. 22, 2017, which claim priority to U.S. provisional patent application 62/303,842, entitled "Timing Ball Apparatus", filed on Mar. 4, 2016. This application incorporates the disclosures of all applications mentioned in this paragraph by reference as if fully set forth herein.

TECHNICAL FIELD

The present invention relates generally to a training apparatus, and more specifically, but not limited to, a striking apparatus having a timing ball configured to be punched by knuckles of users' fist for improving their fighting skills in all fighting art forms.

BACKGROUND OF THE INVENTION

Over the centuries, all fighting art forms such as boxing and/or the martial arts have developed training apparatuses to improve on various skill sets required to execute their fighting techniques or form. These apparatuses have ranged from simple devices such as skipping ropes which improve foot speed, to more complex machines such as the various resistance training machines currently available. All fighting art forms demand a high level of athleticism, speed, timing, balance, and strength. These skills are the fundamental driving forces of any modern athlete, and effective pre-event training is the key to success in an athlete's sport of choice.

Modern athletes have learned that isolating particular skill sets vastly improves their ability to compete in their particular sport. For example, a boxer or mixed martial artist may break up his or her training sessions to incorporate skipping rope, for foot speed and coordination; lifting weights, to improve strength; punching of a heavy bag, to improve striking and strength simultaneously; using a treadmill, to improve cardiovascular; using a speed ball, to improve hand-eye coordination, speed, and timing; using a medicine ball, to improve plyometric motion; and sparring which integrates all the above-mentioned skills.

Athletes and coaches are always looking to different training apparatuses and techniques to obtain a further advantage over their competitors. Many of these apparatuses however have a number of shortcomings. For example, in boxing and/or mixed martial arts, prior art training apparatuses have their shortcomings such as speed bags, double end bags, or maze balls. The disadvantages and shortcomings for these particular apparatuses are explained below in detail.

The speed bag is a teardrop shaped bag with a rubber air bladder disposed inside of it. It is attached directly to a swivel which is screwed directly to a backboard. By hanging so close to the backboard the speed bag has a very fast rebound. Fast enough that it can bounce off the backboard three times between strikes. A user does not hit the speed bag with the knuckles on their fist as they would when throwing real punches. Instead, a user hits a speed bag with the side of their hand similar to a karate chop, but with the hand balled up in a fist. This kind of strike is called a hammer fist strike. Equally, a user strikes the bag with a hammer fist in a circular motion and has to continuously hit it like this in a rhythm in order to keep the speed bag moving. Notably, it is against the rules in boxing to hit with a hammer fist and this style of throwing punches in a circular motion would likely not hurt an opponent.

The maze ball is another tear drop shaped bag. It is weighted with sand and hangs from a chain that can be hung from anything. You push the bag and as it swings you practice evasive head movement. It does not have a backboard and it is not made to be struck. It is very slow and therefore not a very effective training apparatus.

The double end striking bag also uses a tear drop and/or a round shaped bag. In use, the double end bag can help a user to develop speed, accuracy, foot placement and reflexes. However, the double end bag is not ideal for developing power and the user can develop a lazy habit of not hitting the ball, but instead, letting the ball bounce off their fist from the kinetic energy generated from the movement of the ball.

In light of the shortcomings in the prior art, there is definitely a need for a striking apparatus in the fighting arts such as boxing and/or the mixed martial arts that combines the features of a speed bag, a double end bag, and a maze ball, but is more effective than all three.

SUMMARY OF THE INVENTION

The present invention relates to a striking apparatus that allows a user to strike a timing ball with the knuckles of his or her fist in order to improve their fighting skills for all fighting art forms such as boxing, mixed martial arts or the like.

Another aspect of the present invention is to provide a striking apparatus that improves a user's eye-hand coordination.

An additional aspect of the present invention is to provide a striking apparatus that improves a user's reflexes, sense of timing and/or rhythm and hand speed for combat sports such as boxing and mixed martial arts. The apparatus further allows a user to move around in a natural fighting position when striking the timing ball, thereby enabling the user to develop foot placement and foot positioning when hitting a target.

A further aspect of the invention is to provide a timing ball that is advantageously a cross between a speed bag, a double end bag, and a maze ball but is yet more effective than all three. The timing ball will include a ball similar to that that of a double end bag but it will have a harder shell hanging from an adjustable rope.

Even though the timing ball may resemble an oversized speed bag its function is entirely different. The speed bag is mainly about rhythm and timing to a certain point. A user strikes it with a circular hammer fist motion to a rhythm or in tempo—a punch not allowed in boxing. Once the user has timed the beat of the speed bag, he or she can close their eyes and/or look away because it's going to come back to that exact same spot in time. On the other hand, the timing ball is more complicated. Although it is possible to dribble the timing ball to a beat like that of a speed bag, its function is for both offense and defense. Neither the speed bag nor the double end bag offers any simulation of a counter attack.

The double end bag is another piece of training equipment used by fighters that is made to be hit with real punches. It is either a round or a teardrop type ball, similar to that of the timing ball that is suspended at a specific height by two elastic bands. One band connected from the top of the ball to the ceiling, and the other band connected from the bottom of the ball to the floor and secured by an anchor. When a user hits it, the double end bag shakes back and forth in the same spot. Like that of a speed bag, it will generally always meet at the same spot after being punched by a user offering limited benefits to a fighter.

One of the main differences between the new timing ball and the prior art devices (e.g., speed bag or the double end bag) is that these devices do not offer any type of counter attack (i.e., counter punch) to defend against. When a user strikes the timing ball from the side with a left or right hook it will swing side-to-side. This movement advantageously simulates side-to-side head movement of an opponent allowing the user to practice the timing of this movement with strait punches. Similarly, a user can practice throwing proper uppercut punches when the timing ball is swinging close to them. In fact, the uppercut is probably the most incorrectly thrown punch in boxing because there are few pieces of boxing equipment that are made for practicing uppercuts. Another reason is that the uppercut is only meant to be used in close and boxers are usually taught to fight from a distance. The new timing ball apparatus is an excellent piece of equipment that allows a fighter to develop the proper technique and habit of throwing short crisp uppercut punches (i.e., an uppercut punch not over-extended) from a deadly angle with a lot of force.

Like any good piece of equipment, it takes time and practice to master the timing ball. While using the timing ball, it provides an intense cardio workout since it requires a user to simultaneously move their hands, feet and head which strengthens and conditions the body for combat sports competition. This piece of equipment will also improve the user's ability to time a fast moving target since it requires them to make immediate evasive maneuvers after each punch thrown. Hence, this makes it the ideal work station for boxing and martial arts practice.

In all fighting art forms, timing is the most essential element for a fighter to develop when throwing a punch to strike an opponent. This is exactly why using the new timing ball apparatus is so beneficial for people who train for combat sports. While using the timing ball apparatus, the user is required to time a moving target that is about the size of a human head when throwing punches in their preferred fighting style. When the user throws a strait punch (i.e., jab or cross), the timing ball will rebound right back at them. The movement of the timing ball simulates the timing of a person's head as they step towards the user. If the user does not hit the timing ball as it moves towards them, it will then simulate a counter punch. Accordingly, the user will have to move their head at the right time to avoid being hit.

The timing ball is also great for both beginners and elite fighters. When fist learning to use the timing ball, the user will have to learn how to hit it with single shots. That means one punch at a time until the user learns to hit it with consecutive shots (i.e., combination punching) off the rebounds. The more advanced a user gets the more punches he or she will be able to land in succession. A user's timing gets better when there are fewer rebounds in between combination punches. A user also has to be accurate with their knuckles in order to control the direction the timing ball swings. Once a fighter has developed pin point accuracy and timing, the length of the rope can be shortened to increase the rebound speed which will require the user to adjust his or her own timing since the target will move faster.

An even further aspect of the present invention is to provide a striking apparatus that encourages a user or fighter to keep their hands up otherwise they will get hit in the face as they drop their hands while training. By keeping their hands up high on a daily basis during training, it then becomes a beneficially unnatural feeling through memory muscle for a fighter to drop their hands during sparring or in competition.

The present invention also advantageously provides the benefit of "learned behavior" and "memory muscle" by having the striking apparatus move towards the user's face when working the timing ball, thereby enabling the user or fighter to become accustomed to having an object moving inches towards them without flinching or closing their eyes. Accordingly, a fighter who can more readily see punches coming at them can then defend against them and is in return more effective at countering and making his or her opponent miss.

An additional feature of the invention is to provide a striking apparatus that can help to develop the user's shoulder muscles when working or striking the timing ball.

A further feature of the invention is to provide a striking apparatus that advantageously helps a user to develop his or her fast twitch muscles because of the intensity, explosiveness, speed and urgency involved when striking the timing ball.

Another aspect of the invention is to provide a timing ball that will swing back immediately at a user's face after being struck giving the effect of a counter punch, thereby enabling and/or requiring the user to develop evasive head movement from counter punches.

An even further aspect of the invention is to provide a training apparatus that can be used by fighters who have damaged hands and/or wrists. The timing ball is not heavy and is filled with air so it is generally a soft target. A fighter with moderate hand damage will not always be able to hit a heavy bag but will likely be able to advantageously hit the timing ball without pain.

The cornerstone to any good boxing gym is a boxing ring, heavy bag, speed bag and a double end bag. Once the timing ball apparatus is introduced to the boxing and martial arts communities, these and all fighting art forms will see that the timing ball apparatus is more relevant and more effective than all other boxing work stations. And it too will become a corner stone to combat sports training facilities.

Consequently, for a better understanding of the present invention, its functional advantages and the specific objects attained by its uses, reference should be made to the accompanying drawings, claims and descriptive matter in which there are illustrated preferred embodiments of the invention.

DETAILED DESCRIPTION OF THE INVENTION

Introduction

The following detailed description is of the best currently contemplated modes of carrying out various embodiments of the invention. The description is not to be taken in a limiting sense, but is made for at least the purpose of illustrating the general principles of the invention, since the scope of the invention is best defined by the appended claims.

In one embodiment of the current invention, a striking apparatus is used by athletes partaking in a fighting art form such as boxing, said apparatus includes a timing ball; an elongated adjustable rope; a swivel mounted to a swivel plate, wherein said swivel plate is mounted to a backboard; the backboard being attached to a frame; and the timing ball being attached to the elongated adjustable rope, wherein said rope being attached to said swivel.

In another embodiment of the invention, a punching apparatus station is provided for all fighting art forms to improve a user's fighting skills. The punching apparatus station includes a timing ball having a link disposed thereon; an elongated adjustable rope; a swivel mounted to a swivel plate, wherein said swivel plate being mounted to a backboard; the backboard being attached to a frame; and the link disposed on the timing ball being attached to the elongated adjustable rope, wherein said rope being attached to said swivel.

DETAILED DESCRIPTION

Figure 1:
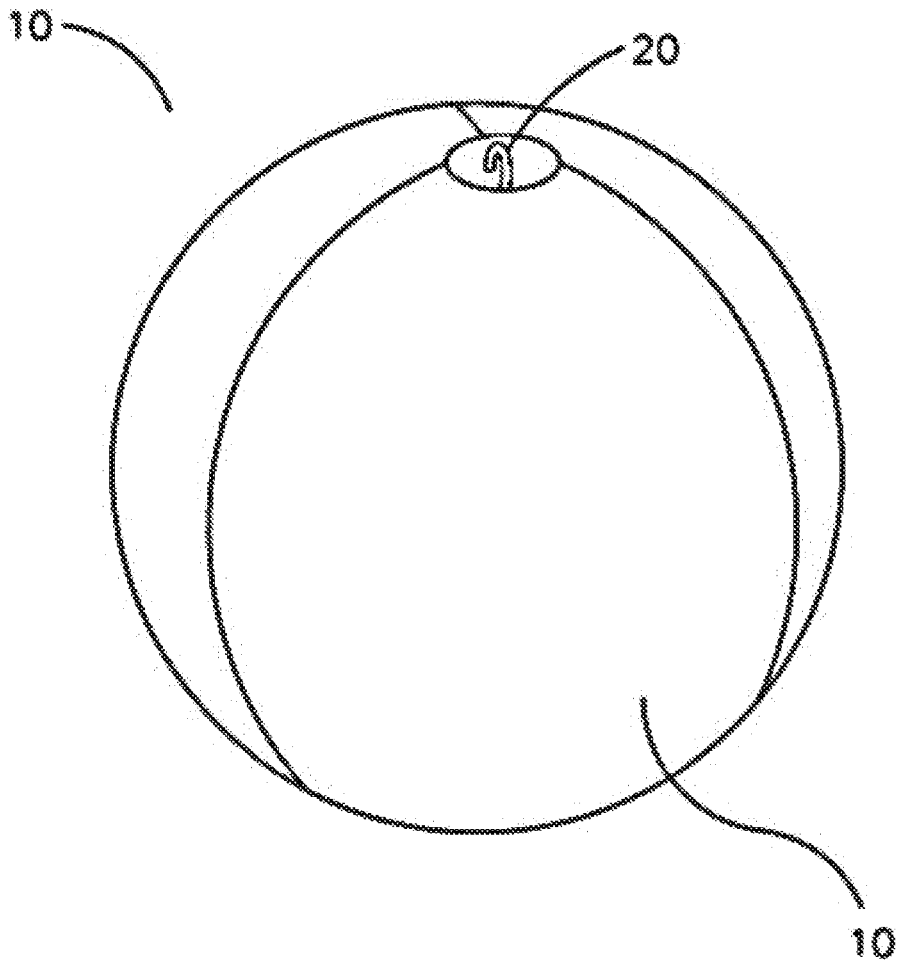
FIG. 1 is a front view of the timing ball.

With reference to FIG. 1, a timing ball 10 having a link 20 for attaching to a rope 30 is shown. In one embodiment, the timing ball is a tether ball 10 having a built in link 20 and is made to be punched with the knuckles of a user's fist. In another embodiment, the timing ball 10 could be a racket type ball 10 that is about the size of a softball. In a further embodiment, the rope 30 could optionally be made out of bungee style rope.

Figure 2:
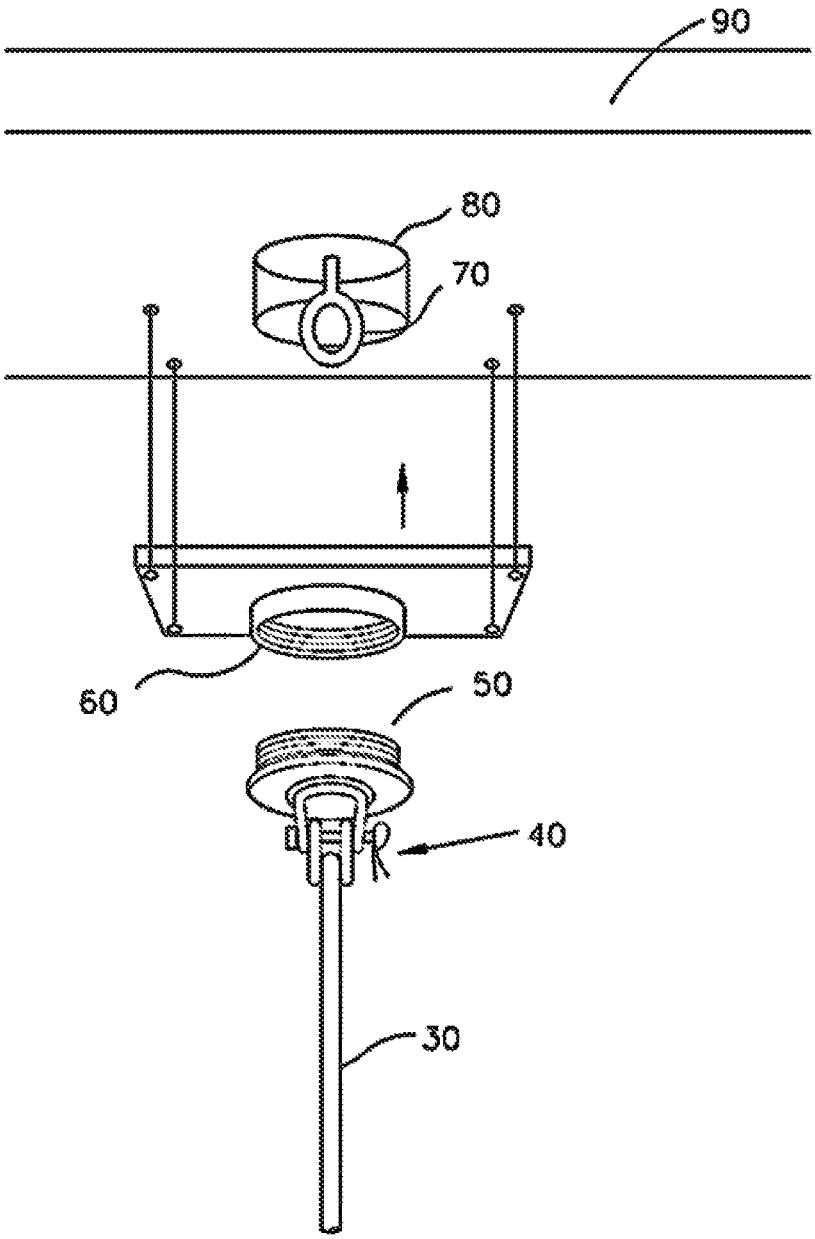
FIG. 2 is a front perspective view of the timing ball swivel.
Figure 9:
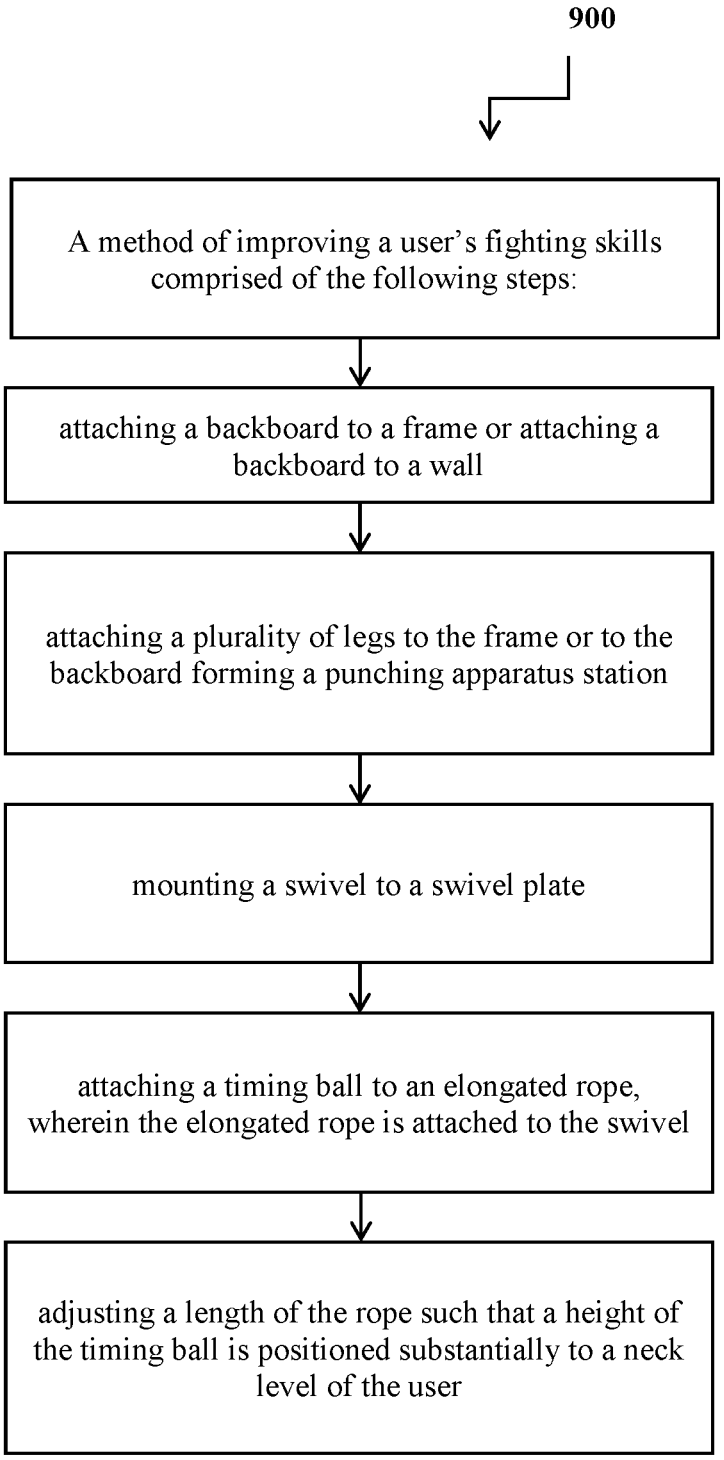
FIG. 9 represents an execution diagram directed to a method of improving a user's fighting skills.

Alternatively, the timing ball 10 could be an eight pound like medicine ball 10 that is padded and wrapped in leather. In this embodiment, the timing ball 10 should be approximately nine to ten inches in diameter. Further, the swivel 40 in this particular embodiment will have a hole in it so that the timing ball 10 can be attached to the eye bolt 70 as shown in FIG. 2. Further, in one embodiment of the present invention, the timing ball 10 will hang from an adjustable rope 30 having a length from 10 inches to 24 inches long. The rope is tied to a swivel that is mounted to a backboard. The backboard must be at least five feet in diameter in this embodiment. It will be suspended by a free standing frame or a wall mount (See also 920 and FIG. 10). These specific dimensions allow the timing ball 10 to simulate a counter attack after being struck by users of various heights (See also FIG. 9, of Method 900).

Figure 3:
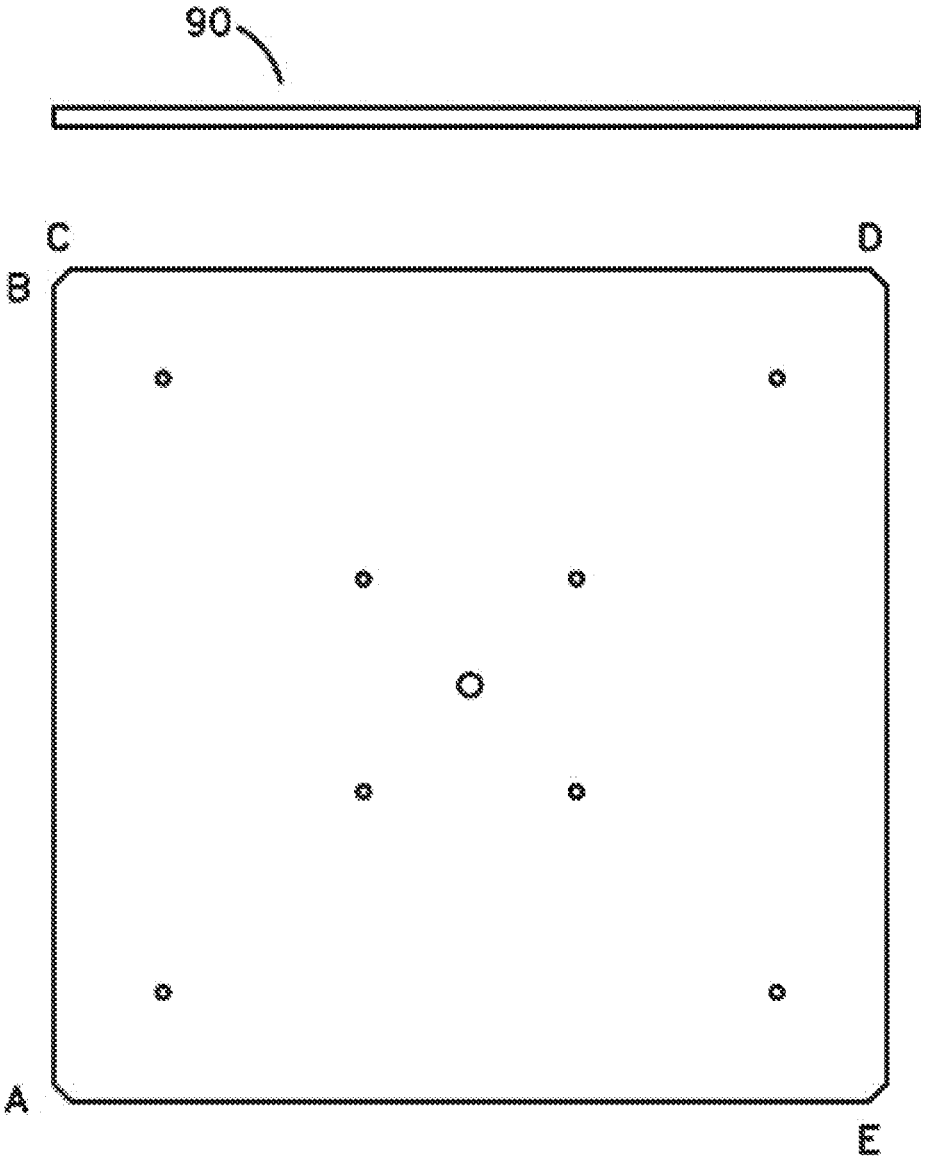
FIG. 3 is a front view of the timing ball backboard.
Figure 7:
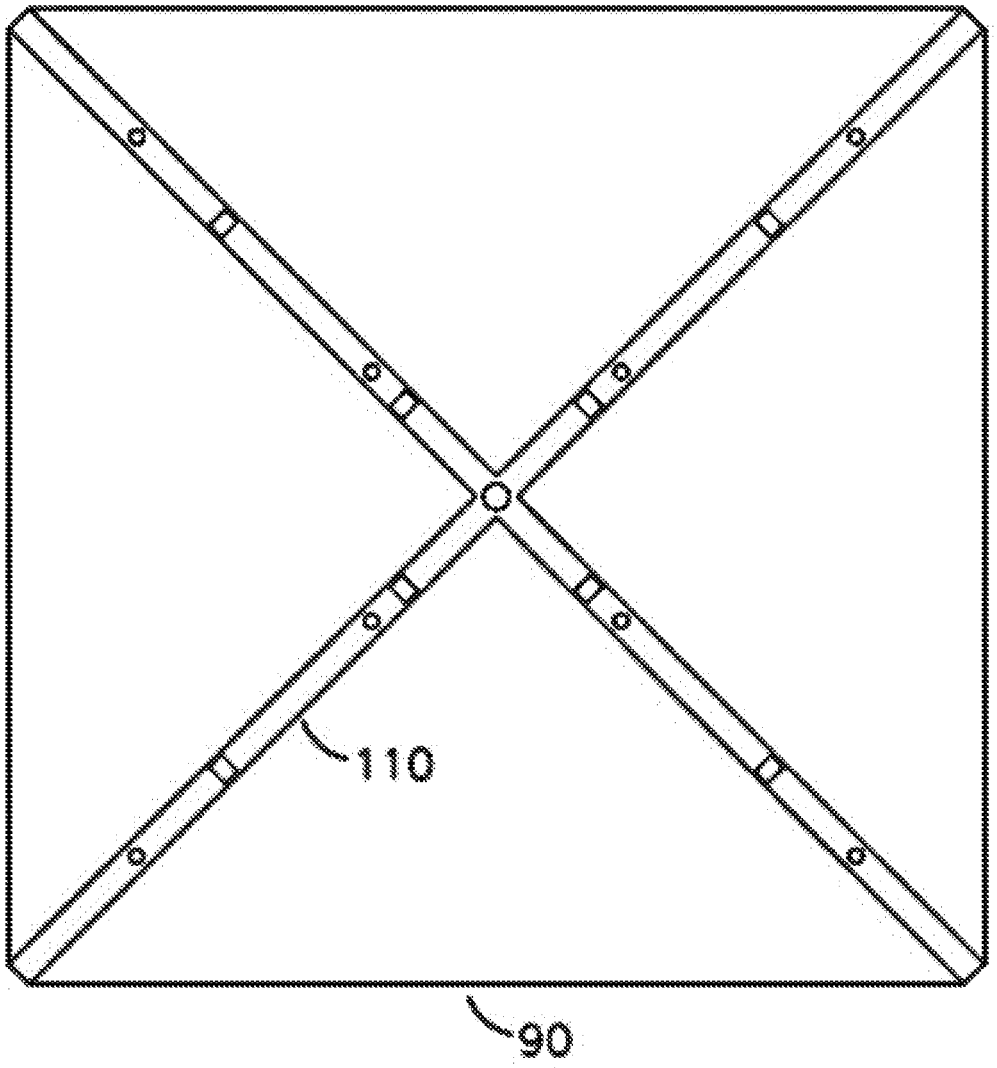
FIG. 7 is a front view of the cross frame mounted to the backboard.

As illustrated in FIG. 2, a timing ball swivel 40 is attached to a rope 30 that includes a plurality of threads 50 for screwing into a swivel plate 60 (See also 930). Additionally, the swivel plate 60 is configured so that it advantageously holds the eyebolt 70 as shown in FIG. 2. Likewise, the swivel plate 60 is configured so that it can be bolted to a backboard 90 (See FIG. 3). In use, a cross frame 100 is bolted or attached to the backboard 90 as illustrated in FIG. 7.

Figure 4:
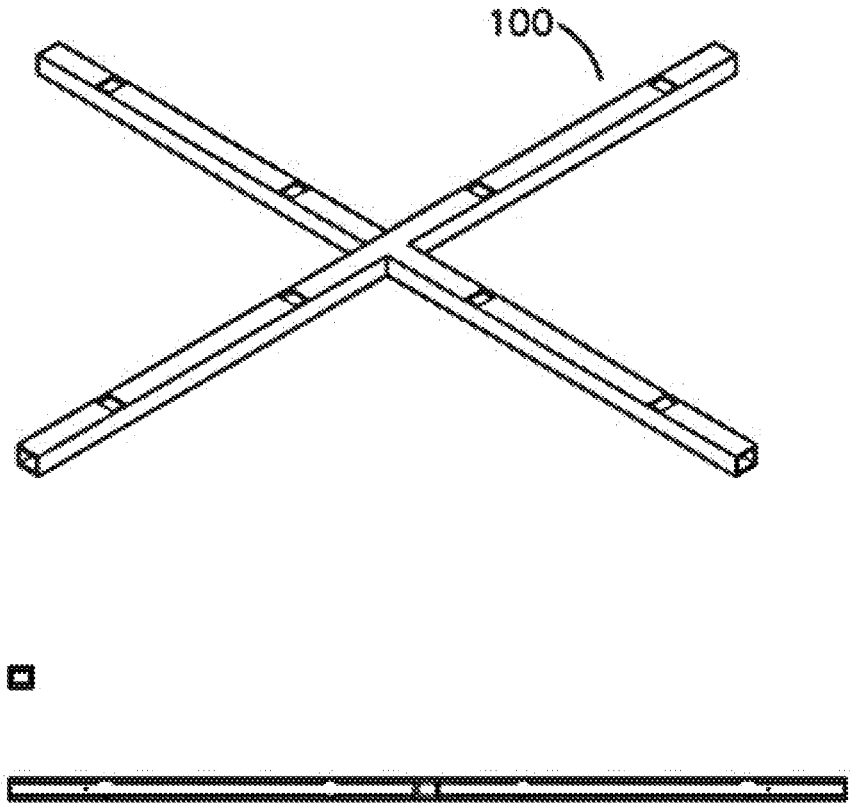
FIG. 4 is a front perspective view of the cross frame.
Figure 5:
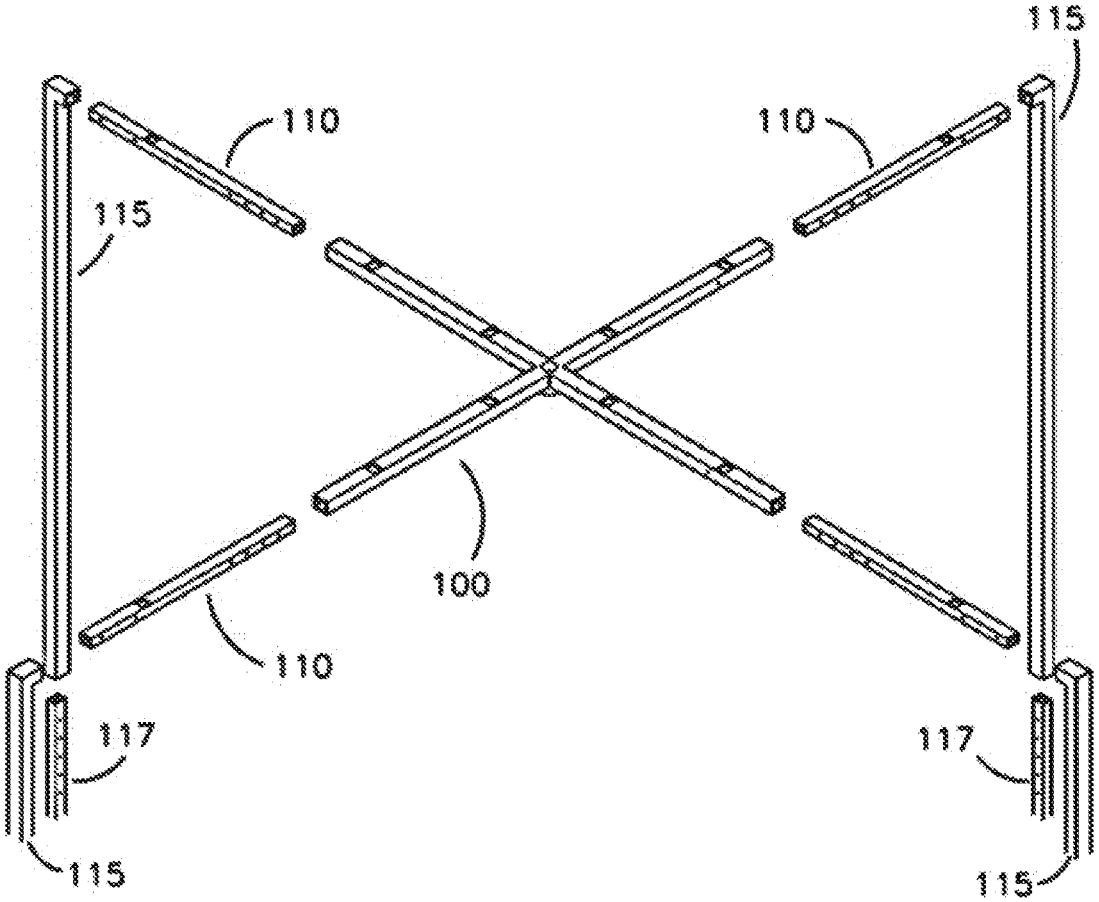
FIG. 5 is a front perspective view of the cross frame and legs.
Figure 6:
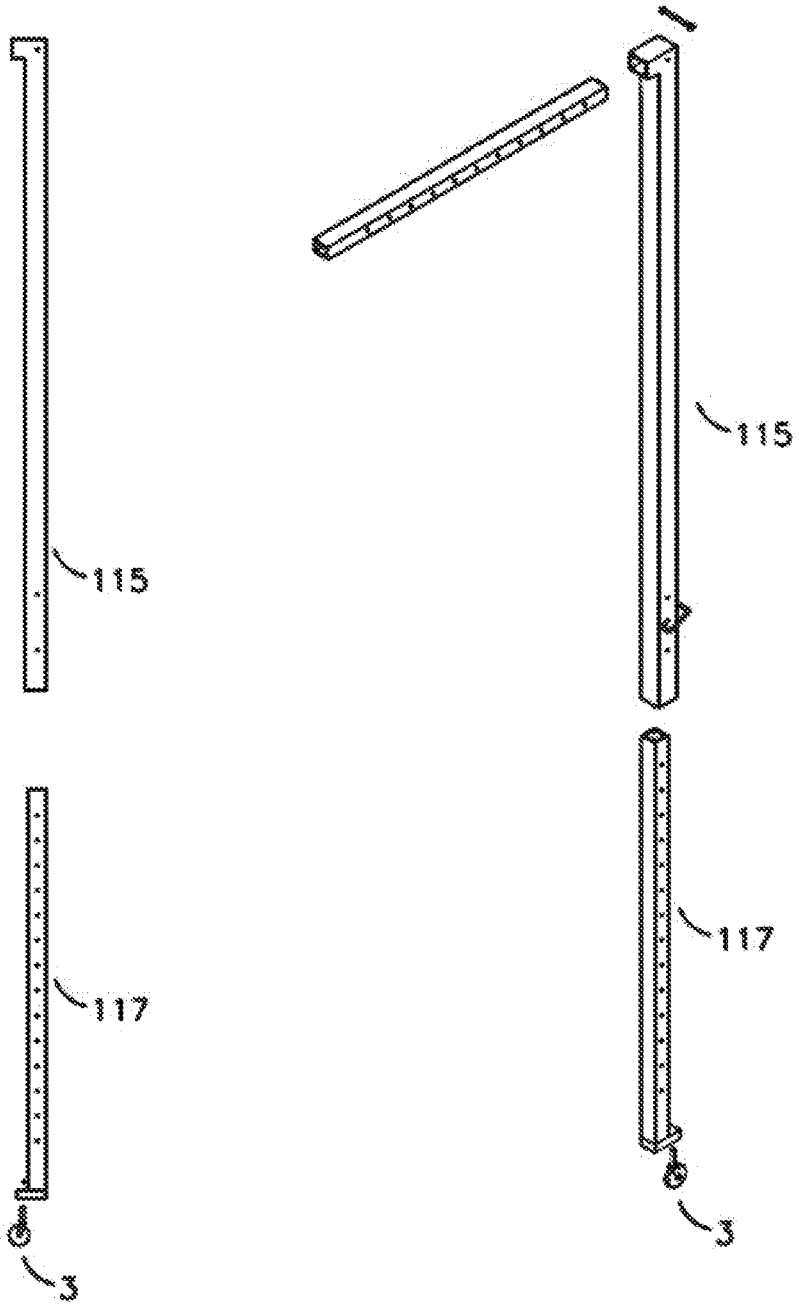
FIG. 6 is a front view of the legs.

Referring now to FIGS. 4, 5, and 6, a cross frame 100 is shown that includes a plurality of locking pin holes for allowing stance extensions 110 to be added to the punching apparatus station 200. The purpose of the stance extensions 100 is to beneficially widen the stance area in the punching apparatus station 200 so that a user or fighter has more space to move around the timing ball 10 for proper development of foot placement during training.

Referring still to FIGS. 4, 5, and 6, the cross frame 100 can be attached to a plurality of legs 115. Alternatively, the stance extensions 110 that are attached to the cross frame 100 can be optionally attached to the plurality of legs 115 when a user wants to increase the stance area. In a further embodiment, leg extensions 117 can be added by attaching them to the legs 115 for advantageously raising or lowering the backboard according to the height of the user (See 930).

The cross frame 100, stance extensions 110, plurality of legs 115, and leg extensions 117 comprising the punching apparatus station 200 can be optionally made of thick steel tubing, wood, metal, alloy, or iron. Further, the punching apparatus station 200 can optionally include a plurality of wheels 3 as shown in FIG. 8 for allowing transportation of said punching station 200.

Figure 8:
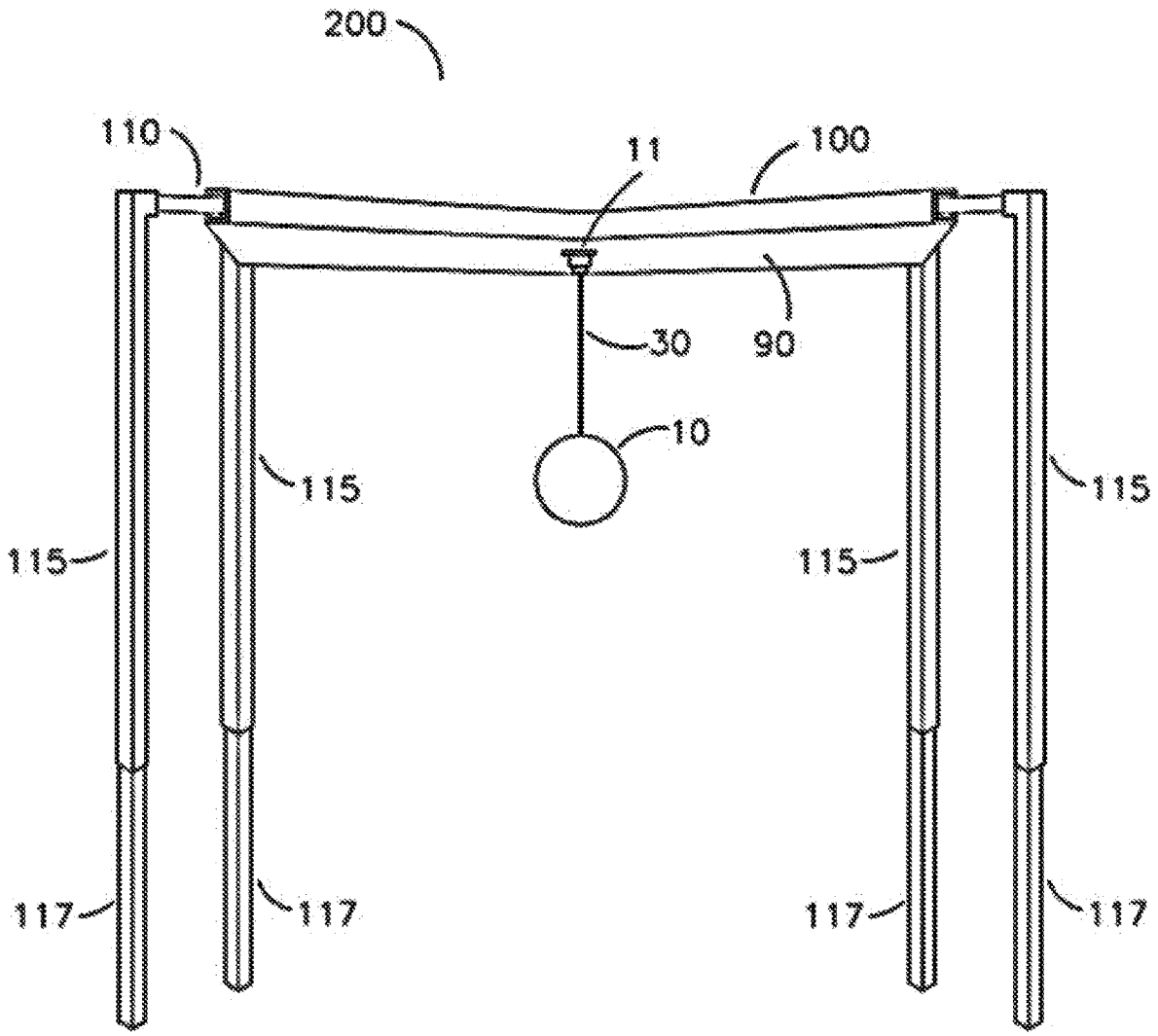
FIG. 8 is a front perspective view of the punching apparatus station.

In use, the timing ball 10 is a substantially round ball that hangs vertically from the adjustable rope 30 that is tied to the swivel 40 as shown in FIG. 8 (See also 950). The swivel 40 is mounted to the backboard similar to a speed bag, but larger. Although the timing ball 10 may resemble an oversize speed bag, its function is entirely different. For instance, the timing ball 10 is struck with the knuckles of a user's fist (i.e., real punches) rather than being struck with the side of a user's hand (hammer fist). A speed bag on the other hand is struck with the sides of a user's hand (hammer fist) which is not a real punch. Additionally, you can use a speed bag on a timing ball mount 11 as shown in FIG. 8, but you cannot use a timing ball 10 on a speed mount.

As previously stated, a speed bag is similar to the timing ball 10 but has different dimensions and a much different effect in use. For instance, the average speed bag is used with a backboard typically 3 feet in diameter. It has a teardrop shaped leather bag with a changeable bladder located within and is mounted directly to a swivel. Importantly, you can use a speed bag on a timing ball backboard but you cannot use a timing ball on a speed bag backboard. Further, the bottom portion of a speed bag typically hangs approximately at the eye level of a user. Conversely, the center portion of the timing ball (i.e., center portion with respect to the diameter of the timing ball) is typically configured to hang substantially at the neck level of the user which allows the user to throw real punches, i.e., how they would be thrown in an actual boxing match (See also 960).

In another embodiment of the present invention, the backboard 90 used with the timing ball 10 has to be at least 4 feet in diameter and in other embodiments could be as large as 7 feet in diameter. The timing ball 10 itself is round and is approximately 10 inches in diameter. It also has a much harder shell than a speed bag and no inner changeable rubber bladder. The timing ball 10 is also used with a rope 30 or a cable extension 30 that is connected to the swivel 40 as shown in FIG. 2. The rope 30 or cable 30 extension must be no less than 10 inches and no longer than 16 inches in this embodiment of the present invention. These specific dimensions advantageously allow the timing ball 10 to simulate a counter attack after being struck by users of various heights where the speed bag does not simulate a counter attack at all.

In use, a user can also adjust the height of the rope 30 by tying knots in it or incorporating alternative embodiments such as links or a buckle system, or the like. The purpose of changing the length of the rope 30 is to change the speed of the timing ball 10 as it approaches the user, thereby requiring the user to change the timing of punches he or she is throwing. Similarly, adjusting the length of the rope 30 causes the user to have to adjust his or her reach so that they have to move their head as the timing ball 10 approaches their face like a counter punch (See also FIG. 9).

In use, the timing ball 10 is similar but different from a "VO BALL®". Notably, the VO BALL® is not sold with a backboard. It includes a rope or a chord that is about 4-6 feet which is attached to a ball that is very similar to a tennis ball. On the other end of the ball is chord that acts as an anchor that you can attach to the ceiling of any room. The effect is similar to that of the timing ball 10 since it simulates a counter attack but since the chord is so long the target is meant to be hit with only a single shot as to where the timing ball 10 is faster than the VO BALL® so you can hit it with punches in succession, or as they say in boxing, hit it with combinations. In short, the timing ball 10 is a much more durable and a more effective training tool for boxing or all other art forms of fighting.

Figure 10:
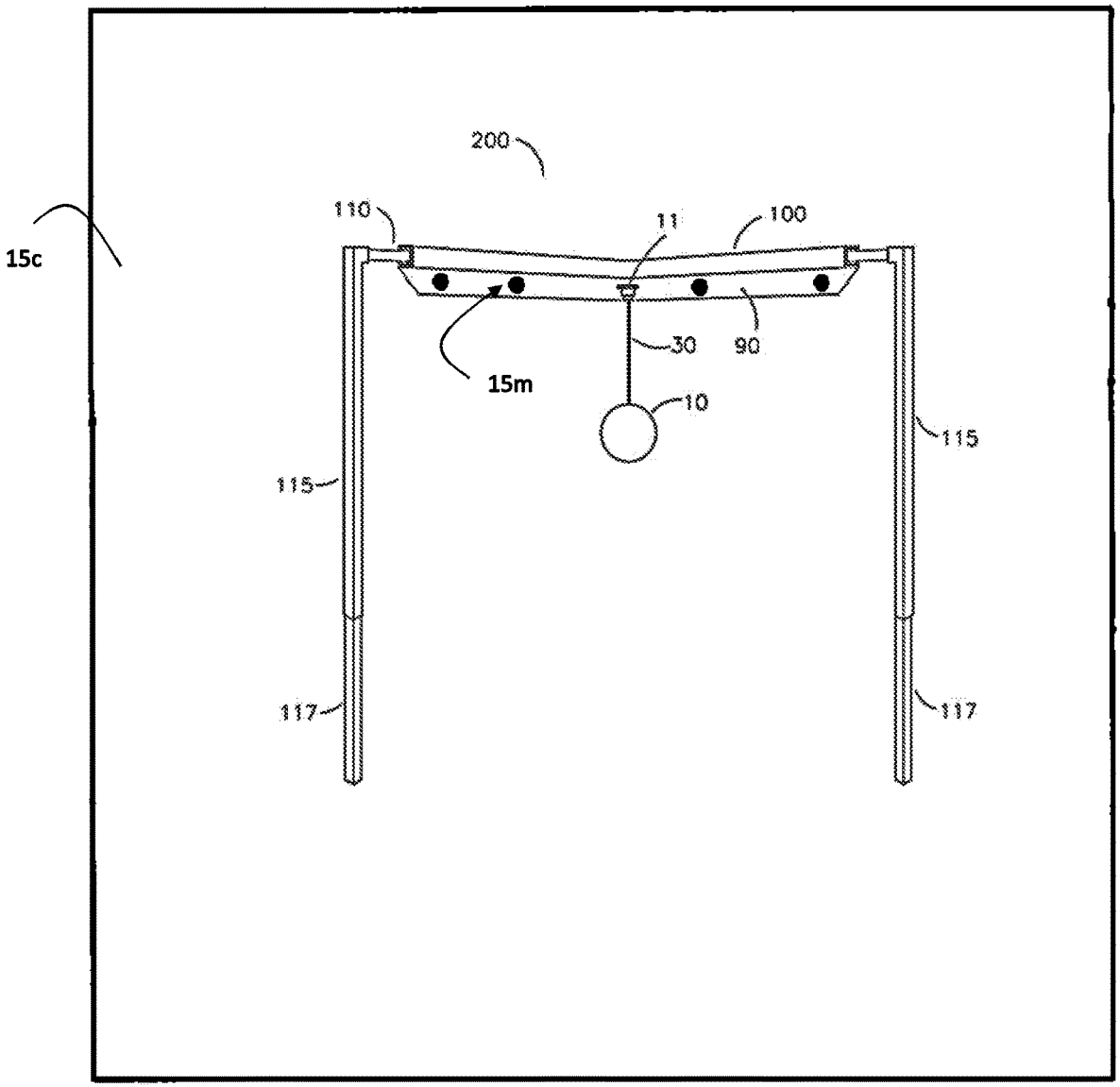
FIG. 10 is directed to a front view of a wall mount punching apparatus station

Optionally, the backboard 90 can be suspended multiple ways. For instance, a wall mount 15*m* design could be implemented instead of the leg concept as shown in FIG. 10. When using the wall mount design, a durable wall 15*w* would have to be used in order to support the weight of it. To utilize a free-standing design, the leg concept will have to be used (See 920/930). In this disclosure, the 15*m* designation refers to the wall mounts. It is well known to a person skilled in the art the various ways to mount a backboard or frame to a wall.

In this specification, the striking apparatus and punching apparatus station can be used for all fighting art forms which include boxing, the martial arts, mixed martial arts or the like.

It should be understood that the foregoing relates to various embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

INDUSTRIAL APPLICABILITY

The invention pertains to a timing ball apparatus and/or a punching apparatus station used for improving an athlete's combative fighting skills, which may be of value or importance to various industries such as boxing and/or the mixed martial arts industry.

What is claimed is:

1. A method of improving a user's fighting skills utilizing a punching apparatus station, the method comprising the following steps:

attaching a backboard to a frame, said backboard being at least 4 feet in diameter, wherein a striking surface of the backboard is substantially flat and is configured to be disposed directly above the user while using the punching apparatus station;

attaching a plurality of legs to the frame to form a punching apparatus station;

mounting a swivel to a swivel plate, the swivel plate being mounted to the backboard;

providing a timing ball, said timing ball comprised of a bladderless tether ball being spherical in shape having a diameter in a range of 9 inches to 10 inches and a link built within said timing ball;

attaching an elongated rope between said swivel and said link of said timing ball; and adjusting a length of the rope such that a height of the timing ball is positioned substantially to a neck level of the user;

wherein the timing ball is configured to be punched by knuckles of a user's fist causing the timing ball to rebound off of the striking surface and swing back immediately towards the user to simulate a counter punch.

2. The method according to claim 1, wherein the frame is attached to four legs forming the punching apparatus station.

3. The method according to claim 2, wherein the frame is a cross frame.

4. The method according to claim 1, wherein a length of the rope is in a range of 10 inches to 16 inches measured from a striking surface of the backboard, thereby allowing users of various heights to strike the timing ball, and to also enable the timing ball to substantially simulate a counter attack for users of various heights after striking said timing ball.

5. The method according to claim 1, wherein the diameter of the backboard is in a range of 4 feet to 7 feet.

6. The method according to claim 1, wherein a length of the rope is adjusted by tying knots thereon such that a height of the timing ball is adjusted substantially to a neck level of the user.

7. A method of improving a user's fighting skills, the method comprising the following steps:

mounting a backboard to a wall;

attaching a plurality of legs to the backboard forming a punching apparatus station, wherein the backboard having the legs attached to one side thereon and the opposing side of the backboard being mounted to the wall;

mounting a swivel to a swivel plate, the swivel plate being mounted to the backboard, wherein the diameter of the backboard is in a range of 4 feet to 7 feet; providing a timing ball, said timing ball comprised of a bladderless tether ball being spherical in shape having a diameter in a range of 9 inches to 10 inches and a link built within said timing ball;

attaching an elongated rope between said swivel and said link of said timing ball; and adjusting a length of the rope such that a height of the timing ball is positioned substantially to a neck level of the user;

wherein the timing ball is configured to be punched by knuckles of a user's fist causing the timing ball to rebound off of the striking surface and swing back immediately towards the user to simulate a counter punch.

8. The method according to claim 7, wherein a striking surface of the backboard is substantially flat and is configured to be disposed directly above a user while using the punching apparatus station.

9. The method according to claim 7, wherein a length of the rope is in a range of 10 inches to 16 inches measured from a striking surface of the backboard, thereby allowing users of various heights to strike the timing ball, and to also enable the timing ball to substantially simulate a counter attack for users of various heights after striking said timing ball.

10. The method according to claim 7, wherein a length of the rope is adjusted by tying knots thereon such that a height of the timing ball is adjusted substantially to a neck level of the user.

11. A method of improving a user's fighting skills, the method punching apparatus station comprising:

a frame;

a backboard attached to said frame, said backboard being at least 4 feet in diameter, wherein a striking surface of the backboard is substantially flat and is configured to be disposed directly above a user while using the punching apparatus station;

a plurality of legs attached to the frame to form said punching apparatus station;

a swivel mounted to a swivel plate, the swivel plate being mounted to the backboard;

a timing ball comprised of a bladderless tether ball being spherical in shape having a diameter in a range of 9 inches to 10 inches and a link built within said timing ball; and an elongated rope attached on one end to said swivel and on a second end to said link of said timing ball, wherein a length of the rope is configured to be adjusted such that a height of the timing ball is capable of being positioned substantially to a neck level of the user;

wherein the timing ball is configured to be punched by knuckles of a user's fist such that the timing ball rebounds off of the striking surface and swings back immediately towards the user to simulate a counter punch.

* * * * *